US006901213B2

(12) United States Patent
Bing

(10) Patent No.: US 6,901,213 B2
(45) Date of Patent: May 31, 2005

(54) ELECTRIC HEATER

(76) Inventor: Bai Bing, Unit 6, 21-23 Henson St., Summer Hill, NSW (AU), 2130

( * ) Notice: Subject to any disclaimer, the term of this patent is extended or adjusted under 35 U.S.C. 154(b) by 0 days.

(21) Appl. No.: 10/444,504

(22) Filed: May 22, 2003

(65) Prior Publication Data

US 2004/0033063 A1 Feb. 19, 2004

(51) Int. Cl.[7] ..... F24H 3/00
(52) U.S. Cl. ..... 392/360; 392/355
(58) Field of Search ..... 392/352–356, 392/360, 365, 368, 374, 376; 219/530, 532, 540

(56) References Cited

U.S. PATENT DOCUMENTS 1,720,334 A * 7/1929 Wilhelm ..... 219/530
1,728,377 A * 9/1929 Trane ..... 219/540
2,060,088 A * 11/1936 Lane ..... 237/79
2,477,778 A * 8/1949 Wright ..... 219/530
2,848,199 A * 8/1958 Drewes, Jr. ..... 219/540
2,993,978 A * 7/1961 Markel et al. ..... 392/352
4,492,851 A * 1/1985 Carr ..... 219/530
2001/0020646 A1 * 9/2001 Hebert ..... 392/353

* cited by examiner

*Primary Examiner*—Teresa J. Walberg
(74) *Attorney, Agent, or Firm*—Raymond V. Chan; David and Raymond

(57) ABSTRACT

An electric heater includes a casing having a receiving compartment and an air outlet communicating the receiving compartment to outside and a plurality of radiant conductive fins spacedly supported in the receiving compartment to define an air heating channel between each two radiant conductive fins, wherein each of the radiant conductive fins has at least a guiding slot formed thereon. A heating element is electrically connected to a power source wherein the heating element is transversely extended to the radiant conductive fins through the guiding slots to heat up the radiant conductive fins in such a manner when the radiant conductive fins are heated up for warming an air within the air heating channels, a heat current is created on each radiant conductive fin for creating heat flows flowing from the air heating channels respectively to outside through the air outlet.

21 Claims, 5 Drawing Sheets

ELECTRIC HEATER

BACKGROUND OF THE PRESENT INVENTION

1. Field of Invention

The present invention relates to a heater, and more particularly to an electric heater which comprises a plurality of spaced apart radiant conductive fins not only for heating up the air between each two radiant conductive fins but also for creating a heat flow to guide the heated air flowing to outside in accordance with the mechanisms of heat transfer.

2. Description of Related Arts

Portable electric heaters have become very popular since the electric heaters are economy, energy effective, and easy operation. In comparison with a central heating system to warm up the surrounding air within the entire house, the electric heater is adapted to warm up a particular area such as an individual room. Therefore, the operation cost of the electric heater is cheaper than that of the central heating system. Generally, there are two types of electric heater, namely the heat core electric heater and the radiant electric heater.

The heat core electric heater generally comprises a bowl shaped reflector body and a heating element disposed therein in such a manner that when the heating element is electrically heated up, the heat from the heat element is reflected by the reflector body to outside. The advantage of the heat core electric heater is that the heating element is heated up quickly such that the heat core electric heater provides an instant heat source for warming up the surrounding air.

However, such heat core electric heater can provide a localized heating coverage area around the reflector body. In other words, the heat core electric heat must be located close to the user in order to directly transfer the heat to the user. If the heat core electric heat is located away from the user, the user is unable to feel the heat therefrom. Therefore, such heat core electric heater is considered as a heat source to warm up the localized area since the heat core electric heater provides a low heat effect. In addition, the heat core electric heater generates not only heat energy but also light energy which is not energy effective. In addition, the heating element is extremely hot when it is heated up so that an object such as curtain around the heat core electric heater will get burnt accidentally.

The radiant electric heater comprises a plurality of vertical heating walls each having a oil chamber for receiving a predetermined volume of thermal conductivity oil therein wherein when the oil is electrically heated up, the oil starts to float upwardly so as to form a circulation of oil in each of the heating walls. By means of convection, the air surrounded the heating walls released to outside to increase the room temperature within the particular area. The radiant electric heater is safe to use since the oil is heated up within the heating wall, which can prevent the surrounding object from getting fire. However, the radiant electric heater is extremely heavy and has a bulky size. It is difficulty for the user to move the radiant electric heater from places to places so that the radiant electric heater has loss a meaning of portability.

Moreover, the major drawback of the radiant electric heater is that the oil requires a long period of time to be heated up. In other words, the radiant electric heater must be switched on to pre-heat the surrounding air in order to reach the desire room temperature. Thus, oil leaking is another major problem of the radiant electric heater after a period of continued use.

As a result, the above two mentioned electric heaters function as a heat source to radiate the heat in a radial direction, wherein no airflow is created to guide the heat evenly distributing to the room. Therefore, the user may merely use a fan to create airflow to distribute the warm air from the electric heater to the surroundings.

SUMMARY OF THE PRESENT INVENTION

A main object of the present invention is to provide an electric heater which comprises a plurality of spaced apart radiant conductive fins not only for heating up the air between each two radiant conductive fins but also for creating a heat flow to guide the heated air flowing along an air heating channel to outside in accordance with the mechanisms of heat transfer.

An object of the present invention is to provide an electric heater, wherein the radiant conductive fins are heated up by a heating element to create a heat current on each radiant conductive fin according to the conduction of heat transfer so as to form the heat flow from the air heating channel.

Another object of the present invention is to provide an electric heater, wherein the air heating channel is defined between each two radiant conductive fins such that when the radiant conductive fins are heated up, the air temperature at the bottom portion of the air heating channel is lower than the air temperature at the upper portion of the air heating channel. Therefore, due to the convection of heat transfer, the air is guided to flow upwardly to create the heat flow along the air heating channel so as to enhance the air circulation in the room.

Another object of the present invention is to provide an electric heater, wherein the radiant conductive fins are made of thermal conductive material such that the radiant conductive fins can be heated up instantaneously so as to provide a quick air heating feature for the electric heater while being energy effective.

Another object of the present invention is to provide an electric heater, which is safe to use since the electric heater provides a flow of warm air in comparison with the conventional electric heater that provides heat directly from the heat source.

Another object of the present invention is to provide an electric heater, wherein no complicated or expensive electrical structure is required to achieve the above mentioned objects of the present invention. Therefore, the present invention provides an economic and efficient solution not only for warming up the surrounding air within the room but also for enhancing the air circulation of the room.

Accordingly, in order to accomplish the above objects, the present invention provides an electric heater, comprising:

a casing having a receiving compartment and an air outlet communicating the receiving compartment to outside;

a plurality of radiant conductive fins spacedly supported in the receiving compartment to define an air heating channel between each two radiant conductive fins, wherein each of the radiant conductive fins has at least a guiding slot formed thereon; and a heating element electrically connected to a power source wherein the heating element is transversely extended to the radiant conductive fins through the guiding slots to heat up the radiant conductive fins in such a manner when the radiant conductive fins are heated up for warming an air within the air heating channels, a heat current is created on each radiant conductive fin for creating heat flows flowing from the air heating channels respectively to outside through the air outlet.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
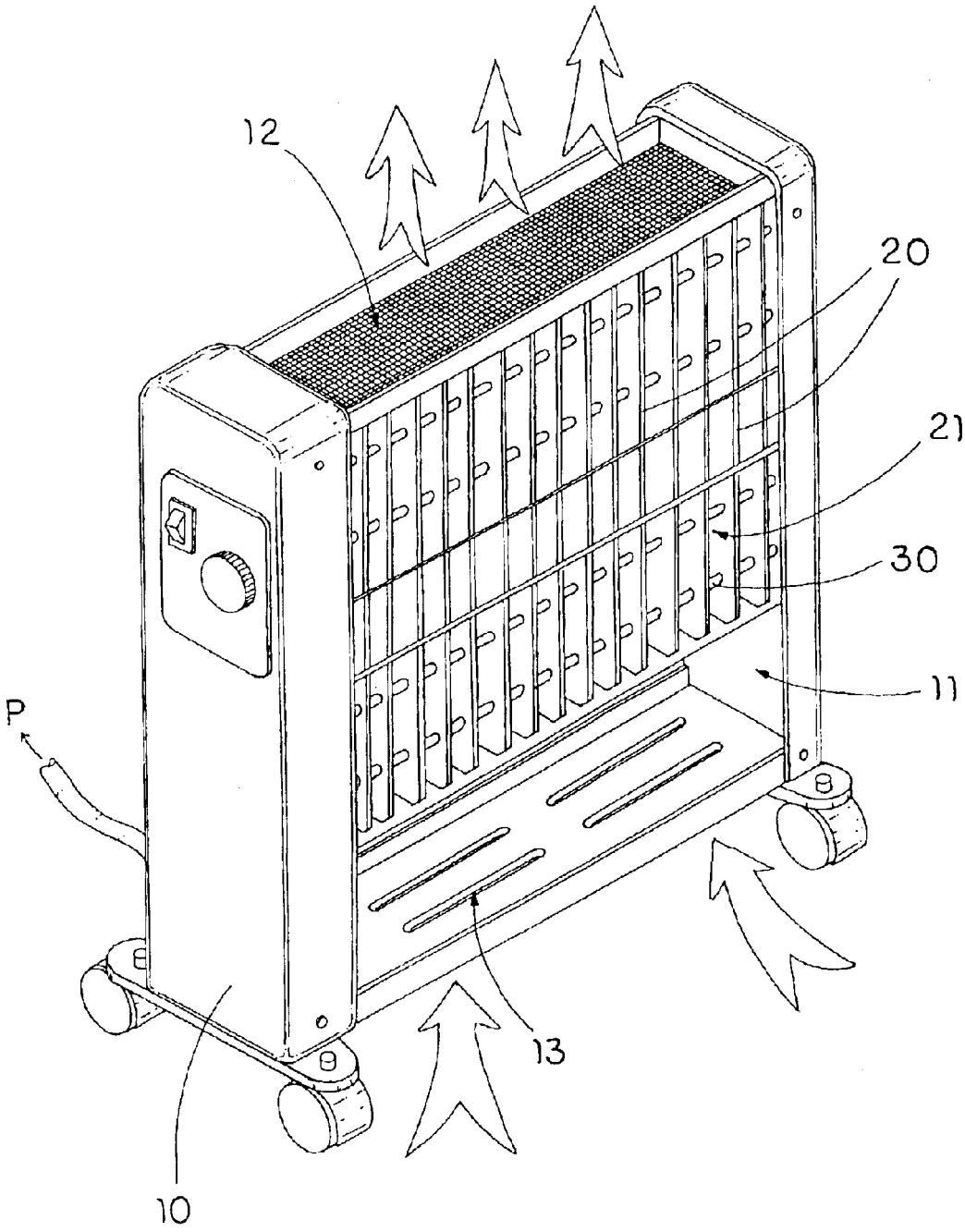
FIG. 1 is a perspective view of an electric heater according to a preferred embodiment of the present invention.
Figure 2:
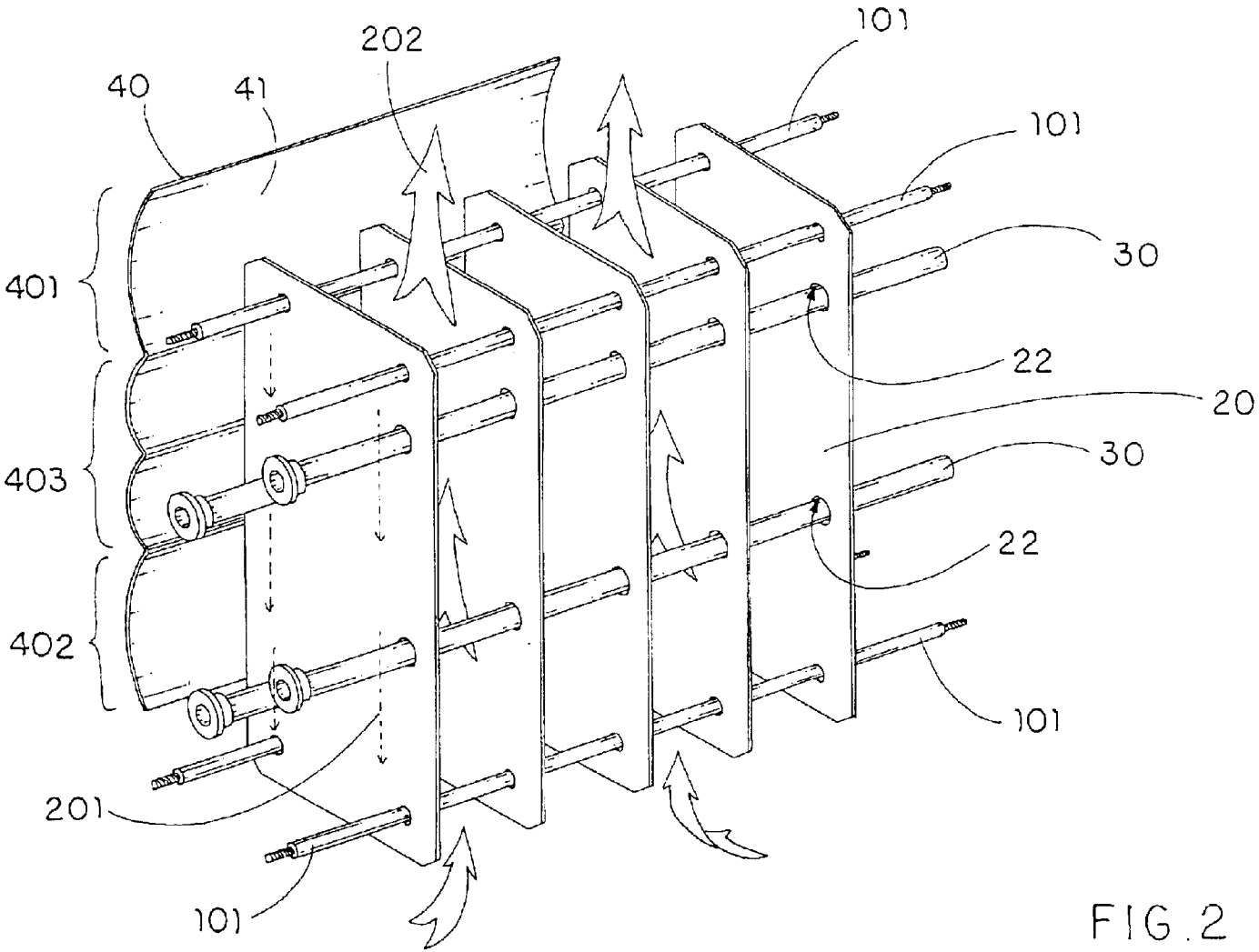
FIG. 2 is a perspective view of the radiant conductive fins of the electric heater according to the above preferred embodiment of the present invention.

Referring to FIGS. 1 and 2 of the drawings, an electric heater according to a preferred embodiment of the present invention is illustrated, wherein the electric heater comprises a casing 10 having a receiving compartment 11 and an air outlet 12 communicating the receiving compartment 11 to outside, a plurality of radiant conductive fins 20, and a heating element 30.

The radiant conductive fins 20 are spacedly supported in the receiving compartment 11 of the casing 10 to define an air heating channel 21 between each two radiant conductive fins 20, wherein each of the radiant conductive fins 20 has at least a guiding slot 22 formed thereon.

The heating element 30 is electrically connected to a power source P wherein the heating element 30 is transversely extended to the radiant conductive fins 20 through the guiding slots 22 to heat up the radiant conductive fins 20 in such a manner when the radiant conductive fins 20 are heated up for warming an air within the air heating channels 21, a heat current 201 is created on each radiant conductive fin 20 for creating heat flows 202 flowing from the air heating channels 21 respectively to outside through the air outlet 12.

According to the preferred embodiment, the radiant conductive fins 20 are spacedly supported in the receiving compartment 11 in a vertically parallel manner via a plurality of transverse supporters 101 wherein each of the air heating channels 21 is formed between each two radiant conductive fins 20 for guiding the air to be heated by the radiant conductive fins 20 and to upwardly flow towards the air outlet 12 of the casing 10.

Each of the radiant conductive fins 20 is made of thermal conductive material such as aluminum, copper, or stainless steel, wherein each of the radiant conductive fins 20 is capable of transferring heat from one region to another region through the conduction. It is worth to mention that conduction of the radiant conductive fin 20 occurs between regions thereof at different temperatures.

Accordingly, when the heating element 30 is heated up, the region of each of the radiant conductive fins 20 around the heating element 30 has a temperature higher than the region of each of the radiant conductive fins 20 away from the heating element 30. Due to the temperature difference on each of the radiant conductive fins 20, the heat flows from the region having a higher temperature to the region having a lower temperature.

In other words, the heat current 201 occurs when the heat is transferred from the region of the radiant conductive fin 20 having a higher temperature to the region thereof having a lower temperature, as shown in FIG. 2.

The heating element 30 is made of infrared heating element, halogen-heating element or other elements which can transform electrical energy into heat energy. As shown in FIG. 2, the heating element 30 is transversely penetrated the radiant conductive fins 20 through the guiding slots 22 in such a manner that when the heating element 30 is heated up, the heat from the heating element 30 is radiated to the radiant conductive fins 20.

The guiding slot 22 of each of the radiant conductive fins 20 is a through circular hole formed on the respective radiant conductive fin 20. Each of the guiding slots 20 has a diameter slightly larger than a diameter of the heating element 30 such that when the heating element 30 passes through the guiding slot 22 to contact with the respective radiant conductive fin 20, a gap is formed between a circumferential edge of the guiding slot 22 and an outer circumferential surface of the heating element 30 for allowing the heating element 30 to be expanded when the heating element 30 is heated up. Accordingly, the gap between the circumferential edge of the guiding slot 22 and the outer circumferential surface of the heating element 30 provides enough space for the expansion of the heating element 30 to prevent the damage of the respective radiant conductive fin 20. Preferably, the gap has a distance in a range from 0.5 mm to 5 mm depending on the material of the heating element 30.

It is known that cool air sinks at the bottom and hot air rises on top of the cool air wherein the heat flows from hotter source to cooler source through equilibrium forming processes in accordance with the theory of convection.

As shown in FIG. 2, when the radiant conductive fins 20 are heated up, the air within each of the air heating channels 21 is warmed up in such a manner that the air flows upwardly along the respective air heating channel 21 as the heat flow 202 to outside through the air outlet 12 of the casing 10. Accordingly, the casing 10 further has an air inlet 13 provided at a lower portion thereof for letting a surrounding air to pass into the casing 10. Therefore, the cooler air is guided to enter the air inlet 13 and is heated up by the radiant conductive fins 20 to form a flow of warmer air when the cooler air passes through the air heating channels 21. Then, the heat flow 202 of the warmer air exits the casing 10 through the air outlet 12 thereof.

It is worth to mention that the radiant conductive fins 20 are cooled down at bottom portions thereof when the cooler air enters the air heating channels 21 respectively. Due to the theory of conduction, the heat current 201 occurs and flows from upper portions of the radiant conductive fins 20 to lower portions thereof. Therefore, the electric heater of the present invention provides an air circulation by sucking the cooler air from the surroundings into the casing 10 and releasing the warmer air to the surroundings by the physical properties of conduction and convection.

Figure 3:
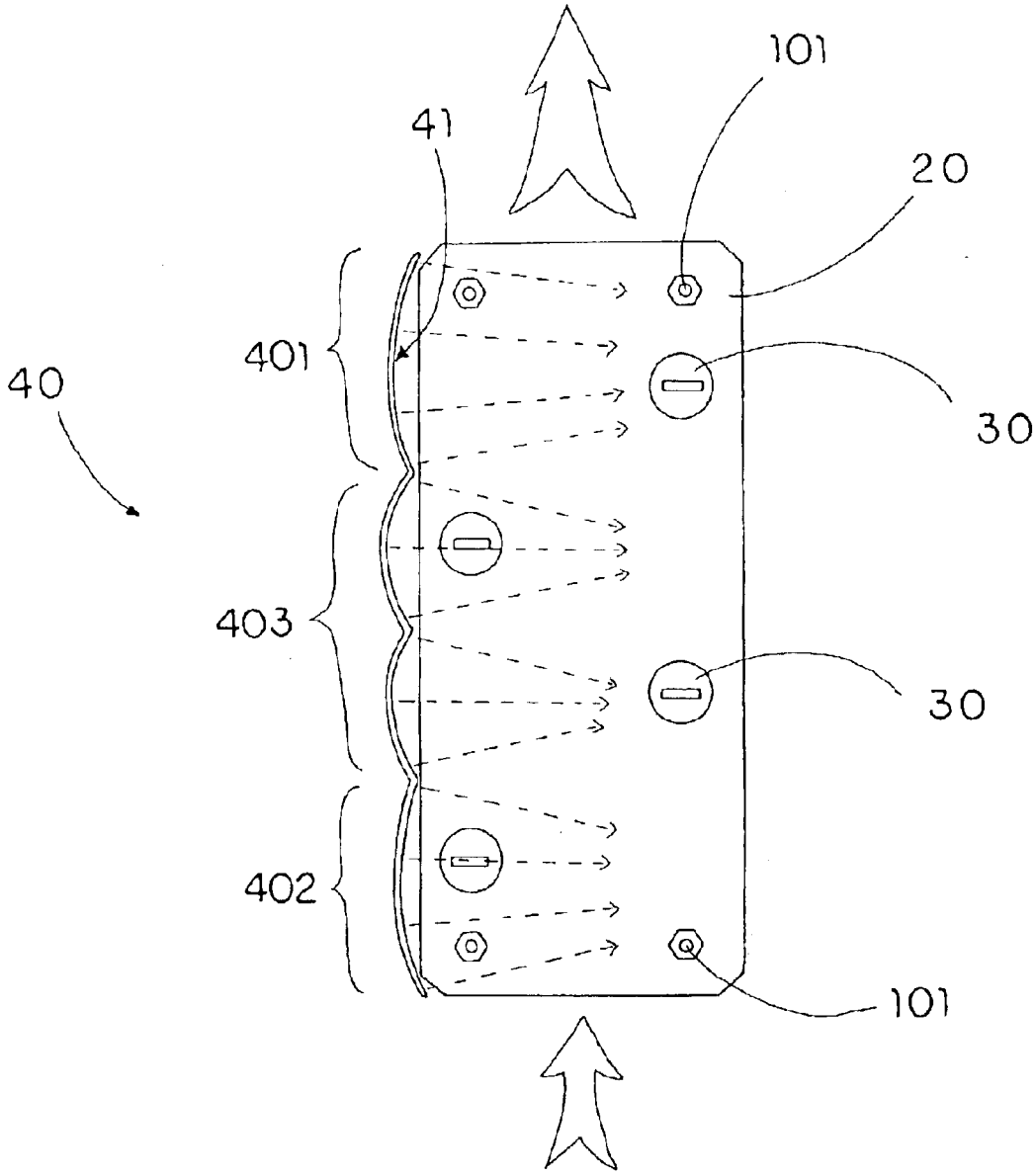
FIG. 3 is a partially sectional view of the electric heater according to the above preferred embodiment of the present invention.

As shown in FIG. 3, the electric heater further comprises a heat reflector 40, having a heat reflecting surface 41, disposed within the receiving compartment 11 at a position transversely extended from the radiant conductive fins 20 at side edges thereof for radiantly guiding the heat current 201 on each of the radiant conductive fins 20. The heat reflecting surface 41 of the heat reflector 40 is arranged to face towards the air heating channels 21 wherein when the radiant conductive fins 20 are heated up by the heating element 30, the heat is reflected by the heat reflecting surface 41 of the heat reflector 40 so as to guide the heat on the radiant conductive fins 20 from regions to regions.

Accordingly, the region of the radiant conductive fin 20 closer to the heating element 30 is hotter than the region of the radiant conductive fin 20 far away from the heating element 30. Therefore, the heat reflector 40 is capable of guiding the heat from the hotter region of the radiant conductive fin 20 to the cooler region thereof to enhance the heat current 201 on each of the radiant conductive fins 20.

As shown in FIG. 3, the heat reflecting surface 41 of the heat reflector 40, having a concave shaped, has a predetermined curvature wherein the heat reflector 40 is arranged for substantially collecting and reflecting the heat from the heating element 30 to a focus point formed on the respective radiant conductive fins 20. In addition, the heater reflector 40 can enhance the heating process for heating up the air within the air heating channels 21 while the heater reflector 40 reflects the heat towards the air heating channels 21.

The heat reflector 40 has a longitudinal upper reflecting portion 401, a longitudinal lower reflecting portion 402, and a longitudinal mid-reflecting portion 403 extended from the upper reflecting portion 401 to the lower reflecting portion 402 wherein each of the upper and lower reflecting portions 401, 402 of the heat reflector 40 has a curvature smaller than a curvature of the mid-portion 403 of the heat reflector 40 in such a manner that the heat reflector 40 is capable of radiantly reflecting the heat towards to a mid-portion of each of the radiant conductive fins 20.

It is worth to mention that the lower portion of each of the radiant conductive fins 20 is cooler than the upper portion thereof when the cooler air comes into the casing 10, the heat reflector 40 is adapted to maintain each of the radiant conductive fins 20 at a predetermined temperature for substantially heating up the air within the air heating channels 21.

In other words, the heat reflector 40 is arranged to guide the heat to downwardly flow along the radiant conductive fins 20 to ensure the heat current 201 occurs on each of the radiant conductive fins 20. Therefore, by selectively adjusting the curvature of the heat reflector 40, the heat current 202 can be controlled on each of the radiant conductive fins 20 so as to control the heat process of the air within the air heating channels 21.

Figure 4:
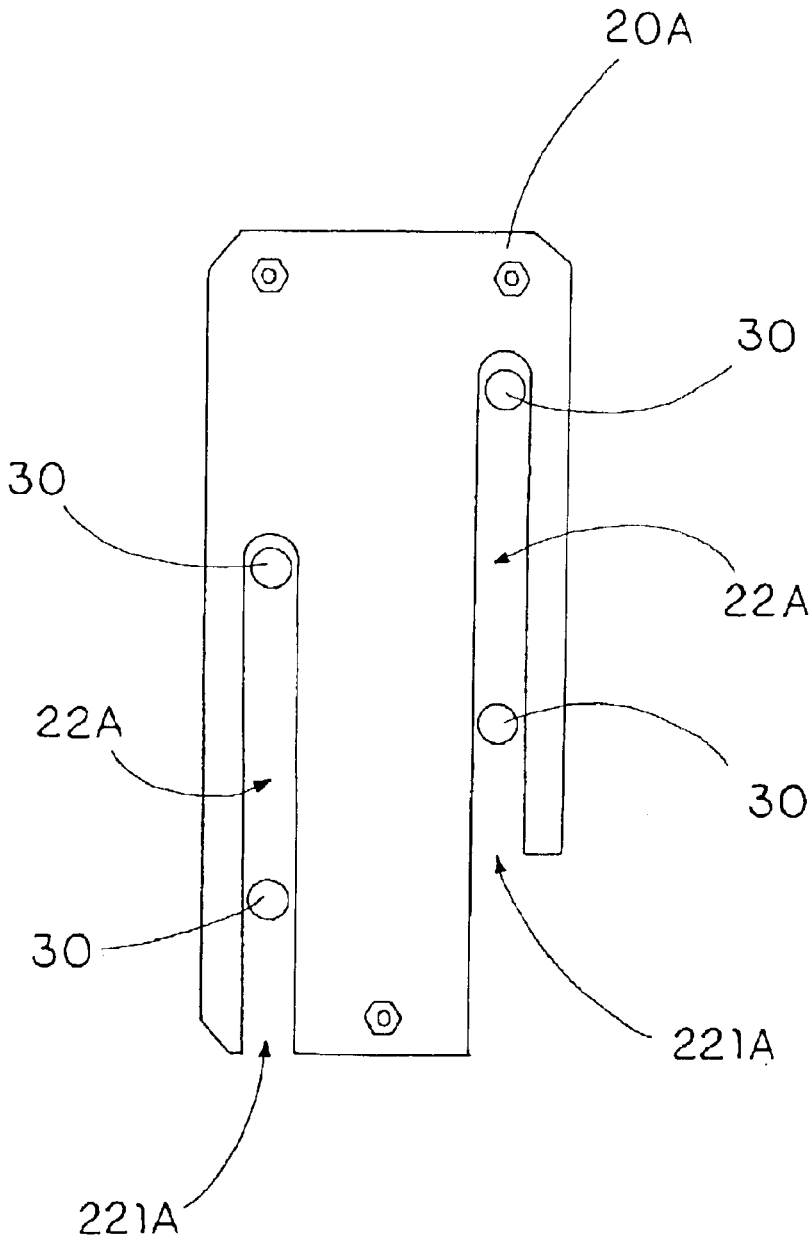
FIG. 4 illustrates a first alternative mode of the guiding slot of the radiant conductive fin of the electric heater according to the above preferred embodiment of the present invention.

FIG. 4 illustrates a first alternative mode of the guiding slot 22A wherein each guiding slot 22A is an elongated through slot formed on the respective radiant conductive fins 20A wherein the guiding slot 22A is downwardly extended on the respective radiant conductive fin 20A to form an opening 221A at a bottom edge of the respective radiant conductive fin 20A in such a manner each of the radiant conductive fins 20A is mounted to the heating element 30 by slotting in the heating element 30 along the guiding slot 22A from the opening 221 A thereof.

Figure 5:
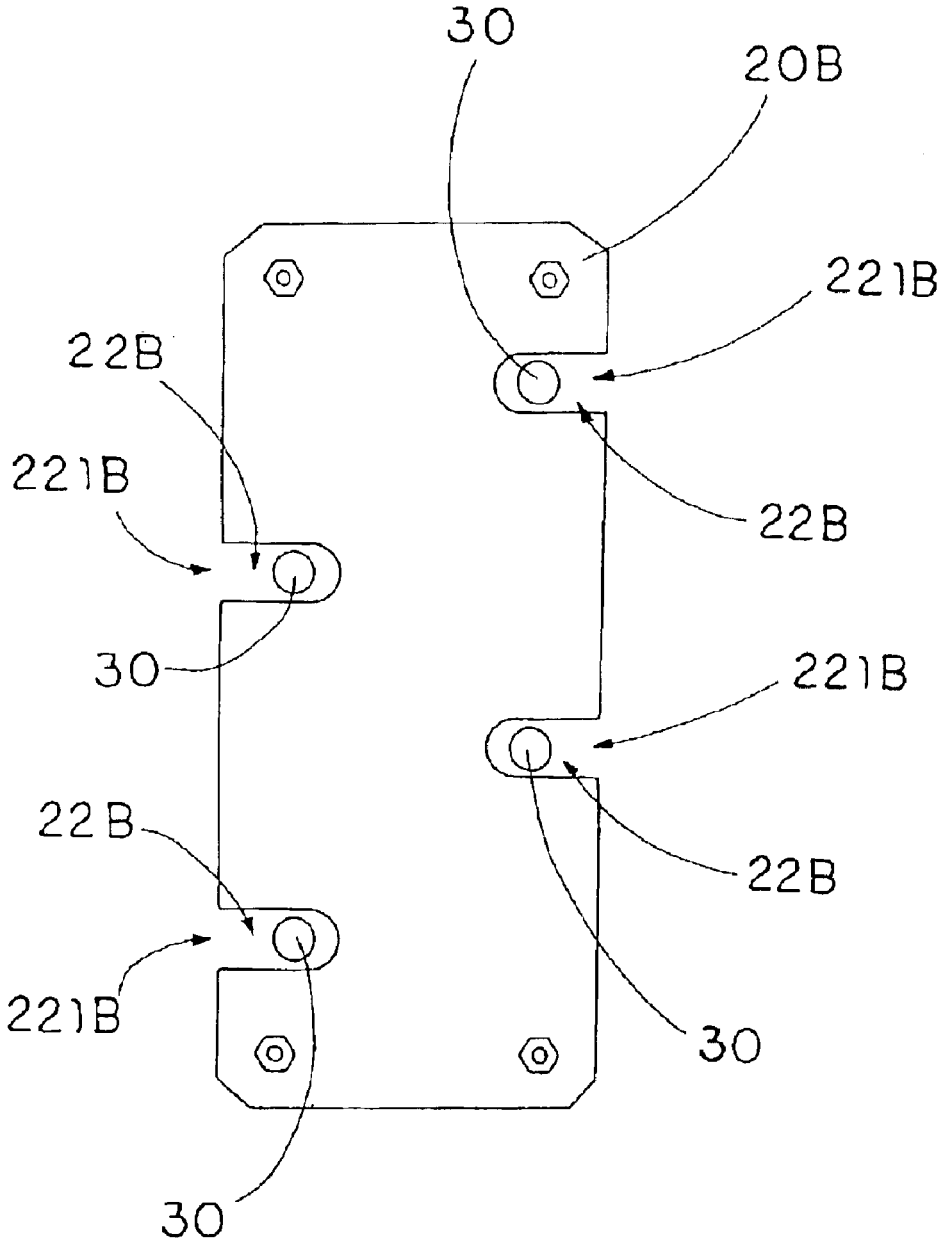
FIG. 5 illustrates a second alternative mode of the guiding slot of the radiant conductive fin of the electric heater according to the above preferred embodiment of the present invention.

FIG. 5 illustrates a second alternative mode of the guiding slot 22B wherein each guiding slot 22B is an elongated through slot formed on the respective radiant conductive fins 20B wherein the guiding slot 22B is sidewardly extended on the respective radiant conductive fin 20B to form an opening 221B at a side edge of the respective radiant conductive fin 20B in such a manner each of the radiant conductive fins 20B is mounted to the heating element 30 by slotting in the heating element 30 along the guiding slot 22B from the opening 221B thereof. It is worth to mention that a width of the guiding slot 22A, 22B should be slightly larger than a diameter of the heating element 30 for allowing the expansion of the heating element 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An electric heater, comprising:

a casing having a receiving compartment, an air outlet formed at a top side for communicating said receiving compartment to outside, and an air inlet formed at a bottom side thereof, wherein said casing further comprises a plurality of transverse supporters spacedly and transversely extended within said receiving compartment;

a plurality of radiant conductive fins spacedly supported in said receiving compartment by said transverse supporters to define an air heating channel between each two said radiant conductive fins, wherein each of said radiant conductive fins has at least a guiding slot formed thereon, wherein each of said air heating channels is aligned between said air inlet and said air outlet for guiding air to flow along said air heating channels from said air inlet to said air outlet; and a heating element, having a diameter slightly smaller than a size of said guiding slot, electrically connected to a power source wherein said heating element is transversely extended to said radiant conductive fins through said guiding slots to define a gap between said heating element and said respective guiding slot, wherein when said heating element radially generates heat, said heat is radiantly distributed through said radiant conductive fins in a planar manner for heating up said air within said air heating channels so as to create heat flows therewithin to outside through said air outlet.

2. The electric heater, as recited in claim 1, wherein said radiant conductive fins are spacedly supported in said receiving compartment in a vertically parallel manner, wherein each of said air heating channels is formed between each two said radiant conductive fins for allowing said air to be heated within said air heating channels and to upwardly flow towards said air outlet of said casing.

3. The electric heater, as recited in claim 1, wherein said guiding slot of each of said radiant conductive fins is a through circular hole formed on said respective radiant conductive fin, wherein each of said guiding slots has a diameter slightly larger than a diameter of said heating element such that when said heating element passes through said guiding slot, said gap is formed between a circumferential edge of said guiding slot and an outer circumferential surface of said heating element such that when said heating element generates said heat, said radiant conductive fins transform said heat in a radial direction into a planar direction.

4. The electric heater, as recited in claim 2, wherein said guiding slot of each of said radiant conductive fins is a through circular hole formed on said respective radiant conductive fin, wherein each of said guiding slots has a diameter slightly larger than a diameter of said heating element such that when said heating element passes through said guiding slot, said gap is formed between a circumferential edge of said guiding slot and an outer circumferential surface of said heating element such that when said heating element generates said heat, said radiant conductive fins transform said heat in a radial direction into a planar direction.

5. The electric heater, as recited in claim 1, further comprising a heat reflector, having a heat reflecting surface, disposed within said receiving compartment at a position transversely extended from said radiant conductive fins at side edges thereof for radiantly guiding said heat on each of said radiant conductive fins.

6. The electric heater, as recited in claim 2, further comprising a heat reflector, having a heat reflecting surface, disposed within said receiving compartment at a position transversely extended from said radiant conductive fins at side edges thereof for radiantly guiding said heat on each of said radiant conductive fins.

7. The electric heater, as recited in claim 4, further comprising a heat reflector, having a heat reflecting surface, disposed within said receiving compartment at a position transversely extended from said radiant conductive fins at side edges thereof for radiantly guiding said heat on each of said radiant conductive fins.

8. The electric heater, as recited in claim 5, wherein said heat reflecting surface of said heat reflector, having a concave shape, has a predetermined curvature, wherein said heat reflector is arranged for substantially collecting and reflecting heat from said heating element to a focus point formed on said respective radiant conductive fins.

9. The electric heater, as recited in claim 6, wherein said heat reflecting surface of said heat reflector, having a concave shape, has a predetermined curvature, wherein said heat reflector is arranged for substantially collecting and reflecting heat from said heating element to a focus point formed on said respective radiant conductive fins.

10. The electric heater, as recited in claim 7, wherein said heat reflecting surface of said heat reflector, having a concave shape, has a predetermined curvature, wherein said heat reflector is arranged for substantially collecting and reflecting heat from said heating element to a focus point formed on said respective radiant conductive fins.

11. The electric heater, as recited in claim 8, wherein said heat reflector has a longitudinal upper reflecting portion, a longitudinal lower reflecting portion, and a longitudinal mid-reflecting portion extended from said upper reflecting portion to said lower reflecting portion, wherein each of said upper and lower reflecting portions of said heat reflector has a curvature smaller than a curvature of said mid-portion of said heat reflector in such a manner that said heat reflector is capable of radiantly reflecting said heat towards to a mid-portion of each of said radiant conductive fins.

12. The electric heater, as recited in claim 9, wherein said heat reflector has a longitudinal upper reflecting portion, a longitudinal lower reflecting portion, and a longitudinal mid-reflecting portion extended from said upper reflecting portion to said lower reflecting portion, wherein each of said upper and lower reflecting portions of said heat reflector has a curvature smaller than a curvature of said mid-portion of said heat reflector in such a manner that said heat reflector is capable of radiantly reflecting said heat towards to a mid-portion of each of said radiant conductive fins.

13. The electric heater, as recited in claim 10, wherein said heat reflector has a longitudinal upper reflecting portion, a longitudinal lower reflecting portion, and a longitudinal mid-reflecting portion extended from said upper reflecting portion to said lower reflecting portion, wherein each of said upper and lower reflecting portions of said heat reflector has a curvature smaller than a curvature of said mid-portion of said heat reflector in such a manner that said heat reflector is capable of radiantly reflecting said heat towards to a mid-portion of each of said radiant conductive fins.

14. The electric heater, as recited in claim 2, wherein said guiding slot is an elongated through slot formed on said respective radiant conductive fins, wherein said guiding slot is downwardly extended on said respective radiant conductive fin to form an opening at a bottom edge of said respective radiant conductive fin, wherein said heating element is slid into along said guiding slot from said opening thereof to mount said radiant conductive fins at said heating element.

15. The electric heater, as recited in claim 14, further comprising a heat reflector, having a heat reflecting surface, disposed within said receiving compartment at a position transversely extended from said radiant conductive fins at side edges thereof for radiantly guiding said heat on each of said radiant conductive fins.

16. The electric heater, as recited in claim 15, wherein said heat reflecting surface of said heat reflector, having a concave shape, has a predetermined curvature, wherein said heat reflector is arranged for substantially collecting and reflecting heat from said heating element to a focus point formed on said respective radiant conductive fins.

17. The electric heater, as recited in claim 16, wherein said heat reflector has a longitudinal upper reflecting portion, a longitudinal lower reflecting portion, and a longitudinal mid-reflecting portion extended from said upper reflecting portion to said lower reflecting portion, wherein each of said upper and lower reflecting portions of said heat reflector has a curvature smaller than a curvature of said mid-portion of said heat reflector in such a manner that said heat reflector is capable of radiantly reflecting said heat towards to a mid-portion of each of said radiant conductive fins.

18. The electric heater, as recited in claim 2, wherein said guiding slot is an elongated through slot formed on said respective radiant conductive fins, wherein said guiding slot is sidewardly extended on said respective radiant conductive fin to form an opening at a side edge of said respective radiant conductive fin, wherein said heating element is slid into along said guiding slot from said opening thereof to mount said radiant conductive fins at said heating element.

19. The electric heater, as recited in claim 18, further comprising a heat reflector, having a heat reflecting surface, disposed within said receiving compartment at a position transversely extended from said radiant conductive fins at side edges thereof for radiantly guiding said heat on each of said radiant conductive fins.

20. The electric heater, as recited in claim 19, wherein said heat reflecting surface of said heat reflector, having a concave shape, has a predetermined curvature, wherein said heat reflector is arranged for substantially collecting and reflecting heat from said heating element to a focus point formed on said respective radiant conductive fins.

21. The electric heater, as recited in claim 20, wherein said heat reflector has a longitudinal upper reflecting portion, a longitudinal lower reflecting portion, and a longitudinal mid-reflecting portion extended from said upper reflecting portion to said lower reflecting portion, wherein each of said upper and lower reflecting portions of said heat reflector has a curvature smaller than a curvature of said mid-portion of said heat reflector in such a manner that said heat reflector is capable of radiantly reflecting said heat towards to a mid-portion of each of said radiant conductive fins.

* * * * *